US008573022B2

(12) United States Patent
Thors et al.

(10) Patent No.: US 8,573,022 B2
(45) Date of Patent: Nov. 5, 2013

(54) METHOD FOR MAKING ENHANCED HEAT TRANSFER SURFACES

(75) Inventors: Petur Thors, Decatur, AL (US); Nikolai Zoubkov, Moscow (RU)

(73) Assignee: Wieland-Werke AG (DE)

( * ) Notice: Subject to any disclaimer, the term of this patent is extended or adjusted under 35 U.S.C. 154(b) by 1315 days.

(21) Appl. No.: 11/759,835

(22) Filed: Jun. 7, 2007

(65) Prior Publication Data

US 2007/0234871 A1 Oct. 11, 2007

Related U.S. Application Data

(60) Division of application No. 10/972,734, filed on Oct. 25, 2004, now Pat. No. 7,311,137, and a continuation-in-part of application No. 10/458,398, filed on Jun. 10, 2003, now abandoned.

(60) Provisional application No. 60/514,418, filed on Oct. 23, 2003, provisional application No. 60/387,328, filed on Jun. 10, 2002.

(51) Int. Cl.
*B21D 53/02* (2006.01)
*B21C 37/00* (2006.01)

(52) U.S. Cl.
USPC ..... 72/370.16; 72/370.17; 72/71

(58) Field of Classification Search
USPC ..... 72/71, 77, 78, 95, 96, 98, 100, 368, 72/370.16, 370.17, 370.1, 370.18, 370.19, 72/370.2, 370.21, 464; 29/890.049, 29/890.053; 165/133
See application file for complete search history.

(56) References Cited

U.S. PATENT DOCUMENTS

| | | | |
|---|---|---|---|
| 2,314,084 | A | 3/1943 | Fried |
| 3,202,212 | A | 8/1965 | Kritzer |
| 3,454,081 | A | 7/1969 | Kun et al. |
| 3,753,364 | A | 8/1973 | Runyan et al. |
| 3,776,018 | A | 12/1973 | French |
| 3,847,212 | A | 11/1974 | Withers, Jr. et al. |

(Continued)

FOREIGN PATENT DOCUMENTS

| | | | |
|---|---|---|---|
| EP | 0865838 | A | 9/1998 |
| EP | 0522985 | B2 | 2/2000 |

(Continued)

OTHER PUBLICATIONS

Patent Abstracts of Japan, JP-02034237, Furukawa Electric Co Ltd, Published Feb. 5, 1990.

(Continued)

*Primary Examiner* — Teresa M Ekiert
(74) *Attorney, Agent, or Firm* — Kilpatrick Townsend & Stockton LLP

(57) ABSTRACT

The invention relates to enhanced heat transfer surfaces and methods and tools for making enhanced heat transfer surface. Certain embodiments include a boiling surface that include a plurality of primary grooves, protrusions and secondary grooves to form boiling cavities. The boiling surface may be formed by using a tool for cutting the inner surface of a tube. The tool has a tool axis and at least one tip with a cutting edge and a lifting edge. Methods for making a boiling surface are also disclosed, including cutting through the inner surface of a tube to form primary grooves, then cutting and lifting the inner surface to form protrusions and secondary grooves.

19 Claims, 18 Drawing Sheets

(56) References Cited

U.S. PATENT DOCUMENTS

| | | | | |
|---|---|---|---|---|
| 3,886,639 | A | 6/1975 | Pasternak | |
| 3,987,539 | A | 10/1976 | Gravener | |
| 4,166,498 | A | 9/1979 | Fujie et al. | |
| 4,203,311 | A | 5/1980 | O'Connor et al. | |
| 4,561,497 | A | 12/1985 | Nakajima et al. | |
| 4,577,381 | A * | 3/1986 | Sato et al. | 165/133 |
| 4,602,681 | A | 7/1986 | Daikoku et al. | |
| 4,606,405 | A | 8/1986 | Nakayama et al. | |
| 4,624,122 | A | 11/1986 | Bridier | |
| 4,646,548 | A | 3/1987 | Zimmerli et al. | |
| 4,653,163 | A | 3/1987 | Kuwahara et al. | |
| 4,672,834 | A | 6/1987 | Alberto | |
| 4,678,029 | A | 7/1987 | Sasaki et al. | |
| 4,706,355 | A | 11/1987 | Kuhns et al. | |
| 4,794,984 | A | 1/1989 | Lin | |
| 4,819,525 | A | 4/1989 | Rabe | |
| 4,938,282 | A | 7/1990 | Zohler | |
| 5,052,476 | A | 10/1991 | Sukumoda et al. | |
| 5,181,810 | A | 1/1993 | Heule | |
| 5,332,034 | A | 7/1994 | Chiang et al. | |
| 5,351,397 | A | 10/1994 | Angeli | |
| 5,458,191 | A | 10/1995 | Chiang et al. | |
| 5,555,622 | A | 9/1996 | Yamamoto et al. | |
| 5,597,039 | A | 1/1997 | Rieger | |
| 5,655,599 | A | 8/1997 | Kasprzyk | |
| 5,669,441 | A | 9/1997 | Spencer | |
| 5,682,946 | A | 11/1997 | Schmidt et al. | |
| 5,690,167 | A | 11/1997 | Rieger | |
| 5,692,560 | A | 12/1997 | Messant et al. | |
| 5,697,430 | A | 12/1997 | Thors et al. | |
| 5,704,424 | A | 1/1998 | Kohno et al. | |
| 5,709,029 | A | 1/1998 | Innes | |
| 5,755,538 | A | 5/1998 | Heule | |
| 5,775,187 | A | 7/1998 | Nikolai et al. | |
| 5,775,411 | A | 7/1998 | Schuez et al. | |
| 5,782,121 | A | 7/1998 | Wetzels | |
| 5,791,405 | A | 8/1998 | Takiura et al. | |
| 5,803,164 | A | 9/1998 | Schuez et al. | |
| 5,803,165 | A | 9/1998 | Shikazono et al. | |
| 5,862,857 | A | 1/1999 | Ishikawa et al. | |
| 5,915,467 | A | 6/1999 | Ishikawa et al. | |
| 5,933,953 | A | 8/1999 | Spencer et al. | |
| 5,934,128 | A | 8/1999 | Takiura et al. | |
| 5,950,716 | A | 9/1999 | Appelquist et al. | |
| 5,950,718 | A | 9/1999 | Sugitani et al. | |
| 5,975,196 | A | 11/1999 | Gaffaney et al. | |
| 5,996,686 | A | 12/1999 | Thors et al. | |
| 6,000,466 | A | 12/1999 | Aoyagi et al. | |
| 6,018,963 | A | 2/2000 | Itoh et al. | |
| 6,026,892 | A | 2/2000 | Kim et al. | |
| 6,056,048 | A | 5/2000 | Takahashi et al. | |
| 6,067,712 | A | 5/2000 | Randlett et al. | |
| 6,164,370 | A | 12/2000 | Rbinson et al. | |
| 6,167,950 | B1 | 1/2001 | Gupte et al. | |
| 6,173,762 | B1 | 1/2001 | Ishida et al. | |
| 6,173,763 | B1 | 1/2001 | Sano et al. | |
| 6,176,301 | B1 | 1/2001 | Bennett et al. | |
| 6,176,302 | B1 | 1/2001 | Takahashi et al. | |
| 6,182,743 | B1 | 2/2001 | Bennett et al. | |
| 6,298,909 | B1 | 10/2001 | Fukatami et al. | |
| 6,336,501 | B1 | 1/2002 | Ishikawa et al. | |
| 6,766,817 | B2 | 7/2004 | da Silva | |
| 6,918,404 | B2 | 7/2005 | da Silva | |
| 2006/0112535 | A1 | 6/2006 | Thors et al. | |
| 2006/0213346 | A1 | 9/2006 | Thors et al. | |

FOREIGN PATENT DOCUMENTS

| | | | |
|---|---|---|---|
| EP | 0845646 | B1 | 9/2001 |
| EP | 1391675 | A1 | 2/2004 |
| FR | 2268580 | A | 11/1975 |
| JP | 54-068554 | A | 6/1979 |
| JP | 56-059194 | A | 5/1981 |
| JP | S56-59194 | | 5/1981 |
| JP | 61-175486 | A | 8/1986 |
| JP | 62237295 | A | 10/1987 |
| JP | 09108759 | | 4/1997 |
| JP | 09141361 | A | 6/1997 |
| JP | 09295037 | | 11/1997 |
| JP | 10052714 | | 2/1998 |
| JP | 10103886 | | 4/1998 |
| JP | 10197184 | A | 7/1998 |
| JP | 10206061 | | 8/1998 |
| JP | 10281676 | | 10/1998 |
| JP | 11226635 | | 8/1999 |
| JP | 2000193345 | | 7/2000 |

OTHER PUBLICATIONS

Patent Abstracts of Japan, JP-02108410, Furukawa Electric Co Ltd, Published Apr. 20, 1990.
Patent Abstracts of Japan, JP-02112822, Furukawa Electric Co Ltd, Published Apr. 25, 199.
Patent Abstracts of Japan, JP-02133798 , Hitachi Cable Ltd, Published May 22, 1990.
Patent Abstracts of Japan, JP-03124337, Zexel Corp, Published May 27, 1991.
Patent Abstracts of Japan, JP-03268816, Matsushita Refrig Co Ltd, Published Nov. 29, 1991.
Patent Abstracts of Japan, JP-04009210, Matsushita Electric Ind Co Ltd, Published Jan. 14, 1992.
Patent Abstracts of Japan, JP-04091819, Mitsubishi Heavy Ltd, Published Mar. 25, 1992.
Patent Abstracts of Japan, JP-04151473, Hitachi Zosen Crop, Published May 25, 1992.
Patent Abstracts of Japan, JP-04266418, Sumitomo Light Metal Ind Ltd, Published Sep. 22, 1992.
Patent Abstracts of Japan, JP-04319019, Kobe Steel Ltd, Published Nov. 10, 1992.
Patent Abstracts of Japan, JP-04333339, Segawa Kihachiro, Published Nov. 20, 1992.
Patent Abstracts of Japan, JP-05106990, Mitsubishi Shindoh Co., Ltd, Published Apr. 27, 1993.
Patent Abstracts of Japan, JP-05231790 Kobe Steel ltd, Published Sep. 7, 1993.
Patent Abstracts of Japan, JP-08035739, Sumitomo Light Metal Ind Ltd, Published Feb. 6, 1996.
Patent Abstracts of Japan, JP-08313182, Matsushita Electric Ind Co Ltd, Published Nov. 29, 1996.
Patent Abstracts of Japan, JP-08099206, Showa Aluminum Corp., Published Apr. 16, 1996.
Patent Abstracts of Japan, JP-09113169, Matsushita Refrig Co Ltd, Published May 2, 1997.
U.S. Appl. No. 12/622,487, Final Office Action, mailed Oct. 21, 2011.
U.S. Appl. No. 12/622,487, Response to Final Office Action, mailed Dec. 20, 2011.
U.S. Appl. No. 12/622,487, non Final Office Action, mailed Feb. 3, 2012.
U.S. Appl. No. 12/622,487, Notice of Allowance, mailed Jul. 3, 2012, 10 pages.

* cited by examiner

METHOD FOR MAKING ENHANCED HEAT TRANSFER SURFACES

CROSS REFERENCE TO RELATED APPLICATIONS

This application is a divisional of U.S. patent application Ser. No. 10/972,734, filed Oct. 25, 2004, now U.S. Pat. No. 7,311,137 which claims the benefit of U.S. Application Ser. No. 60/514,418, filed on Oct. 23, 2003 and is a continuation-in-part of U.S. application Ser. No. 10/458,398, filed Jun. 10, 2003, now abandoned which claims the benefit of U.S. Application Ser. No. 60/387,328, filed Jun. 10, 2002.

BACKGROUND

1. Field of the Invention

The invention relates generally to enhanced heat transfer surfaces and a method of and tool for forming enhanced heat transfer surfaces.

2. General Background of the Invention

The invention relates to enhanced heat transfer surfaces that facilitate heat transfer from one side of the surface to the other. Heat transfer surfaces are commonly used in equipment such as, for example, flooded evaporators, falling film evaporators, spray evaporators, absorption chillers, condensers, direct expansion coolers, and single phase coolers and heaters, used in the refrigeration, chemical, petrochemical and food-processing industries. A variety of heat transfer mediums may be used in these applications including, but not limited to, pure water, a water-glycol mixture, any type of refrigerant (such as R-22, R-134a, R-123, etc.), ammonia, petrochemical fluids, and other mixtures.

Some types of heat transfer surfaces work by using the phase change of a liquid to absorb heat. Thus, heat transfer surfaces often incorporate a surface for enhancing boiling or evaporating. It is generally known that the heat transfer performance of a surface can be enhanced by increasing nucleation sites on the boiling surfaces, by inducing agitation near a single-phase heat transfer surface, or by increasing area and surface tension effects on condensation surfaces. One method for enhancing boiling or evaporating is to roughen the heat transfer surface by sintering, radiation-melting or edging methods to form a porous layer thereon. A heat transfer surface having such a porous layer is known to exhibit better heat transfer characteristics than that of a smooth surface. However, the voids or cells formed by the above-mentioned methods are small and impurities contained in the boiling liquid may clog them so that the heat transfer performance of the surface is impaired. Additionally, since the voids or cells formed are non-uniform in size or dimension, the heat transfer performance may vary along the surface. Furthermore, known heat transfer tubes incorporating boiling or evaporating surfaces often require multiple steps or passes with tools to create the final surface.

Tube manufacturers have gone to great expense to experiment with alternative designs including those disclosed in U.S. Pat. No. 4,561,497 to Nakajima et al., U.S. Pat. No. 4,602,681 to Daikoku et al., U.S. Pat. No. 4,606,405 to Nakayama et al., U.S. Pat. No. 4,653,163 to Kuwahara et al., U.S. Pat. No. 4,678,029 to Sasaki et al., U.S. Pat. No. 4,794,984 to Lin and U.S. Pat. No. 5,351,397 to Angeli.

While all of these surface designs aim to improve the heat transfer performance of the surface, there remains a need in the industry to continue to improve upon tube designs by modifying existing designs and creating new designs that enhance heat transfer performance. Additionally, a need also exists to create designs and patterns that can be transferred onto tube surfaces more quickly and cost effectively. As described below, the geometries of the heat transfer surfaces of the invention, as well as tools to form those geometries, have significantly improved heat transfer performance.

BRIEF SUMMARY

Embodiments of the invention provide an improved heat transfer surface, such as may be formed on a tube, and a method of formation thereof that can be used to enhance heat transfer performance of tubes used in at least all of the above-referenced applications (i.e., flooded evaporators, falling film evaporators, spray evaporators, absorption chillers, condensers, direct expansion coolers and single phase coolers and heaters, used in the refrigeration, chemical, petrochemical and food-processing industries). The surface is enhanced with a plurality of cavities that significantly decrease the transition time to move from one phase to the next, for example to move from boiling to evaporation. The cavities create additional paths for fluid flow within the tube and thereby enhance turbulence of heat transfer mediums flowing within the tube. Protrusions creating cavities also provide extra surface area for additional heat exchange. Tests show that performance of tubes according to embodiments of the invention is significantly enhanced.

Certain embodiments of the invention include a method for using a tool, which can be easily added to existing manufacturing equipment, having a mirror image of a pattern of grooves desired to formed on the tube surface. Certain embodiments of the invention also include using a tool, which also can be easily added to existing manufacturing equipment, having a cutting edge to cut through the surface of tube and a lifting edge to lift the surface of the tube to form protrusions. In this way, protrusions are formed without removal of metal from the inner surface of the tube, thereby eliminating debris which can damage the equipment in which the tubes are used. Finally, certain embodiments of the invention include using a tool, which also can be easily added to existing manufacturing equipment, for flattening or bending the tips of the protrusions, such as a mandrel. The grooves, protrusions and flattened tips on the tube surface can be formed in the same or a different operation. In certain embodiments of the invention, the three tools are secured on a single shaft and the tube surfaces are formed in one operation.

Heat transfer surfaces formed in accordance with embodiments of the invention may be used on the inner or outer surface of a heat transfer tube or may be used on flat heat transfer surfaces, such as are used to cool micro-electronics. Such surfaces may be suitable in any number of applications, including, for example, applications for use in the HVAC, refrigeration, chemical, petrochemical and food processing industries. The physical geometries of the protrusions may be changed to tailor the tube to a particular application and fluid medium.

DETAILED DESCRIPTION

It should be understood that a tube in accordance with this invention is generally useful in, but not limited to, any application where heat needs to be transferred from one side of the tube to the other side of the tube, such as in multi-phase (both pure liquids or gases or liquid/gas mixtures) evaporators and condensers. While the following discussion provides desirable dimensions for a tube of this invention, the tubes of this invention are in no way intended to be limited to those dimensions. Rather, the desirable geometries of the tube will depend on many factors, not the least important of which are the properties of the fluid flowing through the tube. One skilled in the art would understand how to alter the geometry of the surfaces of the tube to maximize heat transfer used in various applications and with various fluids. Furthermore, although the drawings show the surface as it would be when found on the inner surface of a tube, it should be understood that the surface is suitable for use on the outer surface of a tube or on a flat surface, such as is used in micro-electronics.

Figure 1:
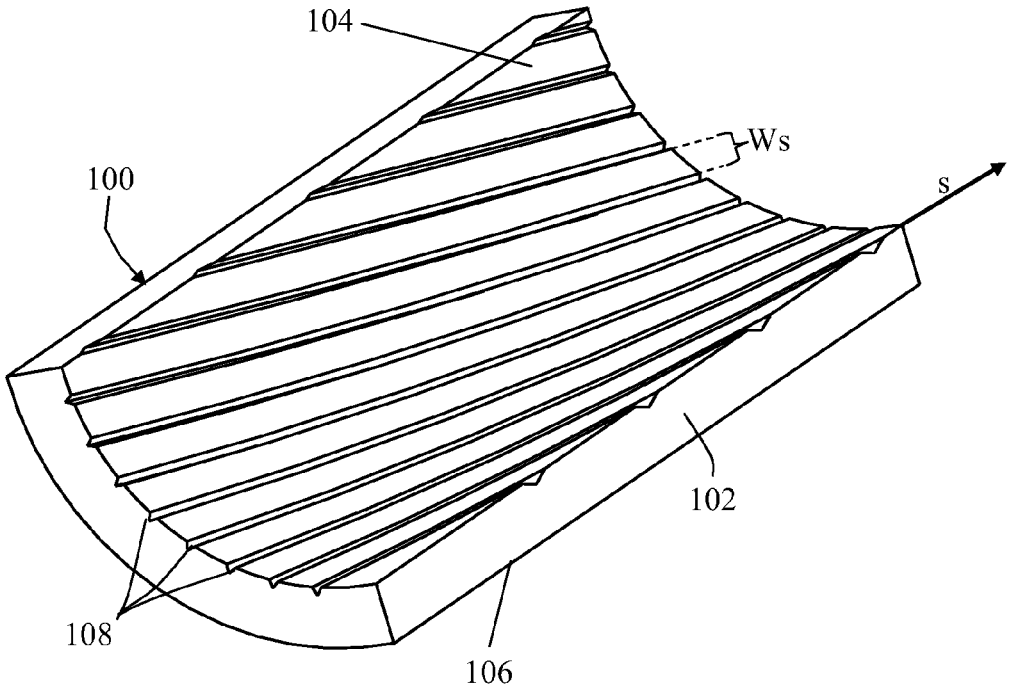
FIG. 1 is a perspective view of a partially-formed boiling surface on the inner diameter of a heat transfer tube according to an embodiment of the invention.

As shown in FIG. 1, certain embodiments of the invention include heat transfer surfaces with primary grooves 108 on the inner surface 104 of tube 100. As one skilled in the art will understand, the number of primary grooves 108 may vary depending on the application in which the heat transfer surface is to be used and depending on the fluid medium used. Primary grooves 108 may be formed by any method including, but not limited to, cutting, deforming, broaching or extrusion. Primary grooves 108 are formed on inner surface 104 at a helix angle $\alpha$ (not shown) to the axis s of the tube 100. Helix angle $\alpha$ may be any angle between 0° and 90°, but preferably does not exceed 70°. One skilled in the art will readily understand that the preferred helix angle $\alpha$ will often depend, at least in part, on the fluid medium used.

The depth of primary grooves 108 should generally be greater the more viscous the liquid flowing through tube 100. For example, a depth of greater than zero, but less than the thickness of the tube wall 102 will generally be desirable. For purposes of this application, the thickness of tube wall 102 is measured from inner surface 104 to outer surface 106.

The axial pitch of the primary grooves 108 depends on many factors, including helix angle $\alpha$, the number of primary grooves 108 formed on inner surface 104 of tube 100, and the inside diameter of tube 100. For purposes of this application, the inside diameter is measured from inner surface 104 of tube 100. An axial pitch of 0.5-5.0 mm is generally desirable, with 1.5 mm.

Certain embodiments of the invention also include protrusions or fins 110. Protrusions 110 may be cut and lifted from the inner surface 104 of tube 100 located between primary grooves 108 so as to have a width $W_s$ defined by adjacent primary grooves 108, as shown in FIGS. 1 and 2A-C. Protrusions 110 are preferably at an angle $\theta$ to axis s to tube 100. The height $e_p$ of protrusions 110 is dependent on the cutting depth t and angle $\theta$ at which inner surface 104 is cut. The height $e_p$ of protrusions 110 is preferably a value at least as great as the cutting depth t, up to three times the cutting depth t. Preferably, the depth of cutting/lifting tool 300 is greater than the depth of primary grooves 108.

The axial pitch $P_{a,p}$ of protrusions 110 may be any value greater than zero and generally will depend on, among other factors, the relative revolutions per minute between the cutting/lifting tool 300 and the tube 100 during manufacture, the relative axial feed rate between the cutting/lifting tool 300 and the tube 100 during manufacture, and the number of tips 302 provided on the cutting/lifting tool 300 used to form the protrusions 110 during manufacture. Preferably, protrusions 110 have an axial pitch $P_{a,p}$ of between 0.05-5.0 mm. The axial pitch $P_{a,p}$ and height will generally depend on the number of protrusions, which height $e_p$ decreases as the number of protrusions increases.

Figure 2A:
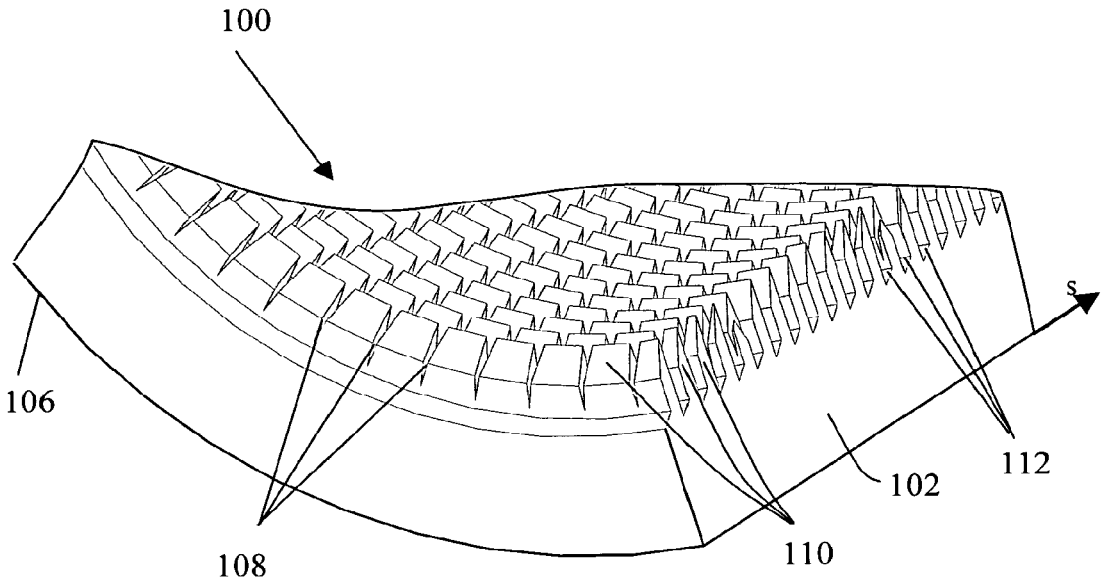
FIG. 2A is a perspective view of the partially-formed boiling surface of the embodiment of FIG. 1.
Figure 2B:
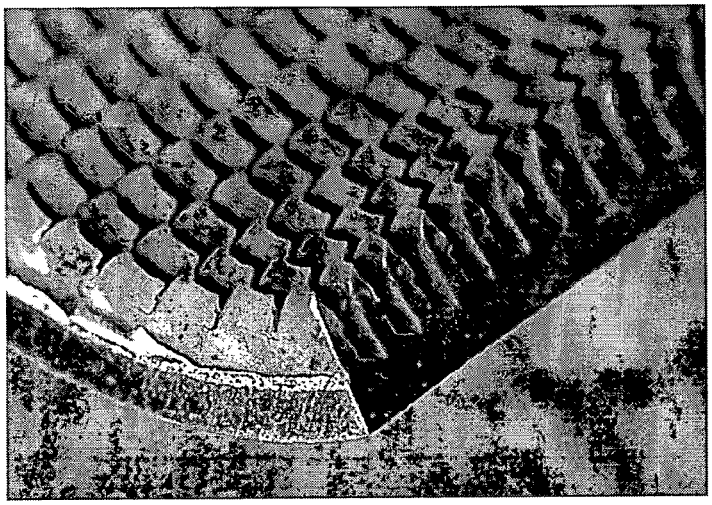
FIG. 2B is a photomicrograph of a perspective view of the partially-formed boiling surface of FIG. 2A.
Figure 2C:
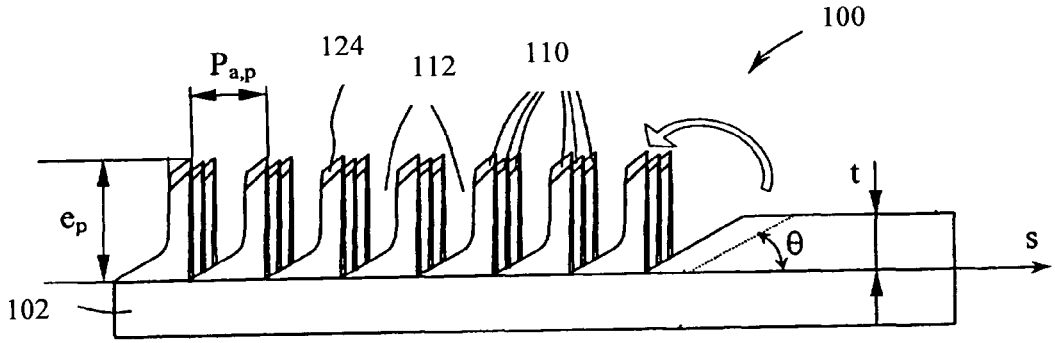
FIG. 2C is a cross-section view of the partially-formed boiling surface of FIG. 2A.

The shape of protrusions 110 is dependent on the shape of inner surface 104 and the orientation of inner surface 104 after primary grooves 108 have been cut relative to the direction of movement of cutting/lifting tool 300. In the embodiment of FIGS. 2A-B, protrusions 110 have four side surfaces 120, a sloped top surface 122 (which helps decrease resistance to heat transfer), and a substantially pointed tip 124.

Figure 4A:
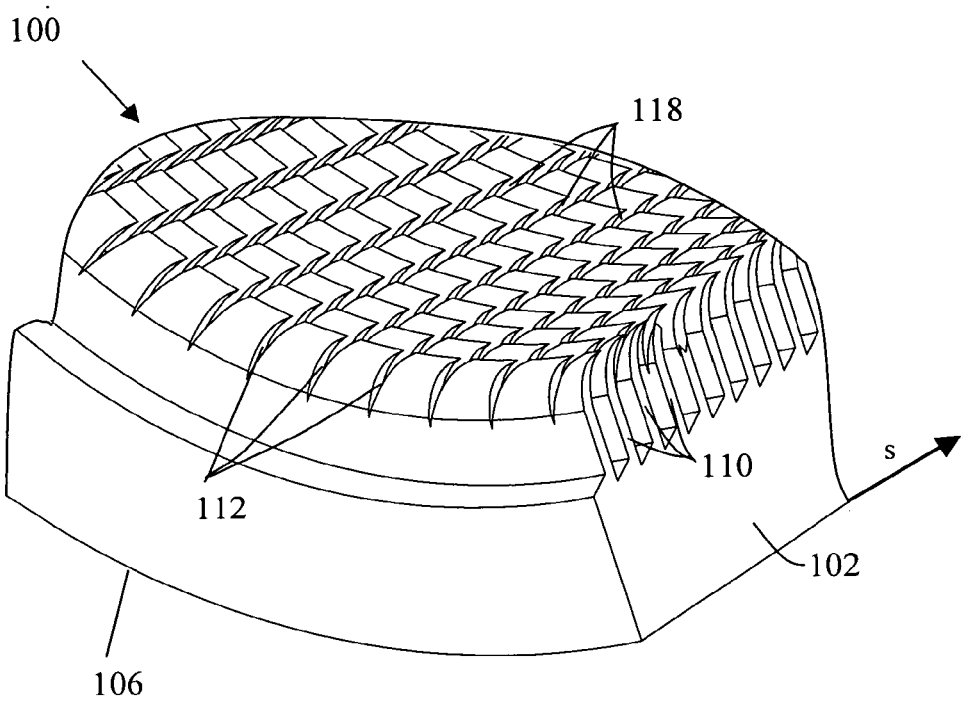
FIG. 4A is a perspective view of a boiling surface on the inner diameter of a heat transfer tube according to an alternative embodiment of the invention.
Figure 4B:
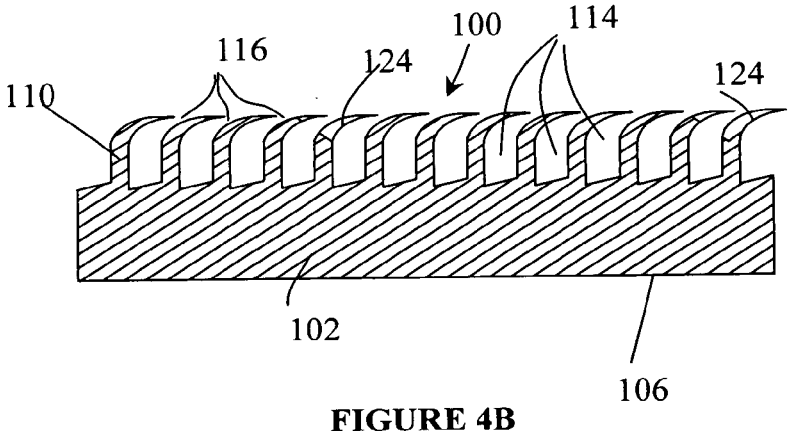
FIG. 4B is a cross-sectional view of the tube shown in FIG. 4A.
Figure 5A:
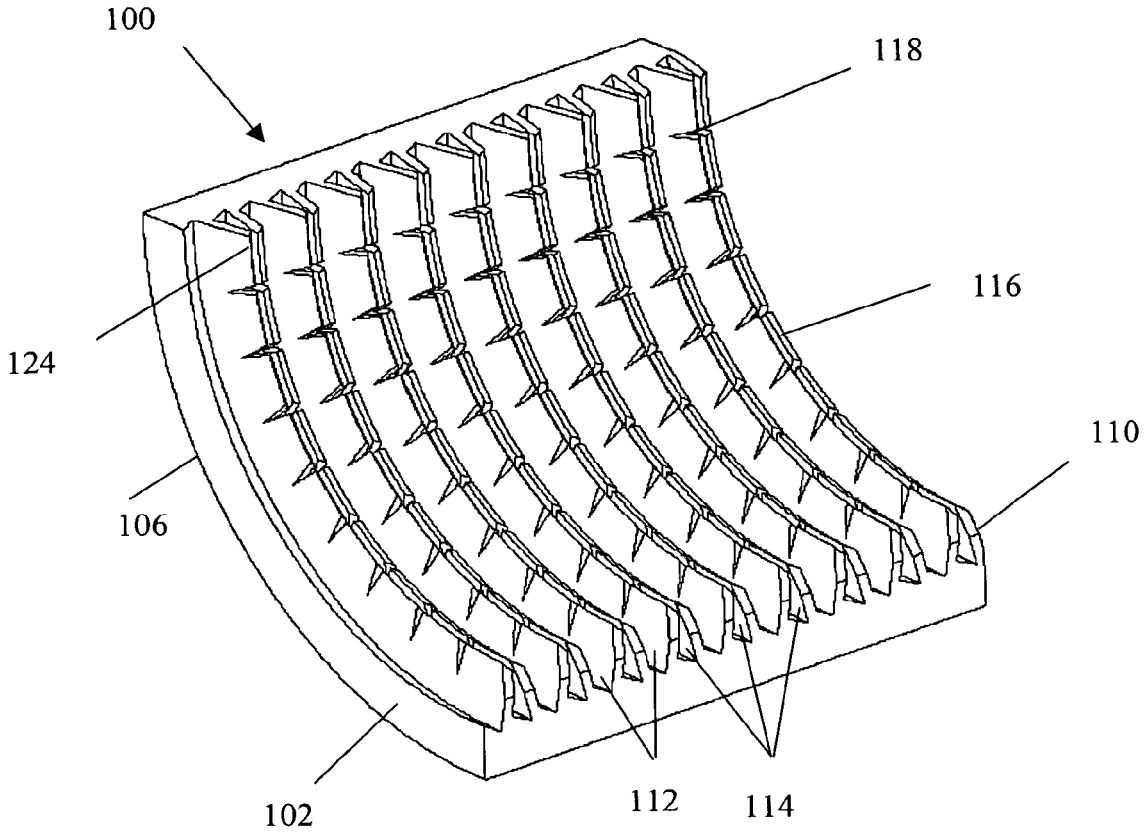
FIG. 5A is a perspective view of a boiling surface on the inner diameter of a heat transfer tube according to an alternative embodiment of the invention.
Figure 5B:
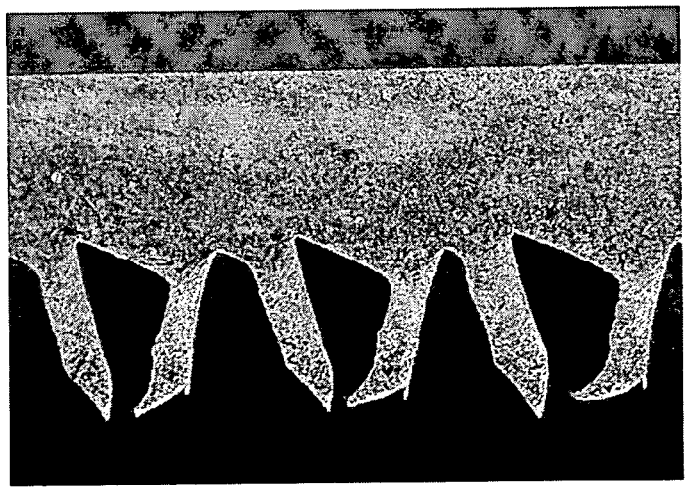
FIG. 5B is a photomicrograph of a cross-section of the boiling surface of FIG. 5A.

The tips 124 of protrusions 110 optionally may be flattened to create boiling cavities 114, as shown in FIGS. 3A-D. Alternatively, the tips 124 of protrusions 110 may be bent to create boiling cavities 114, as shown in FIGS. 4A-B. In other embodiments, the tips 124 of protrusions 110 may be thickened to create boiling cavities 114. In still other embodiments, the protrusions 110 may be angled toward each other, such as shown in FIGS. 5A-B, to create boiling cavities 114. One with skill in the art will understand that the tips 124 of protrusions 110 may remain substantially straight (not bent or flattened) and substantially perpendicular to the inner surface 104 of the tube 100 if a condensing surface is desired. However, if a boiling or evaporation surface is desired, the creation of boiling cavities 114 may substantially increase the efficacy of the boiling surface. The creation of boiling cavities 114 creates a path for fluid flow and increases the transition from liquid to boiling or boiling to vapor.

The protrusions 110 of this invention are in no way intended to be limited to the illustrated embodiment, however, but rather can be formed in any shape. Moreover, protrusions 110 in tube 100 need not be the same shape or have the same geometry.

As shown in FIG. 2A, secondary grooves 112 may be located between adjacent protrusions 110. Secondary grooves 112 are oriented at an angle $\tau$ (not shown) to the axis s of tube 100. Angle $\tau$ may be any angle between approximately 80° and 100°. Preferably, angle $\tau$ is approximately 90°. The depth of secondary grooves 112 is between the depth of primary grooves 108 and the height depth of protrusions 110. Preferably, the depth of secondary grooves 112 is greater than the depth of primary grooves 108.

Figure 6:
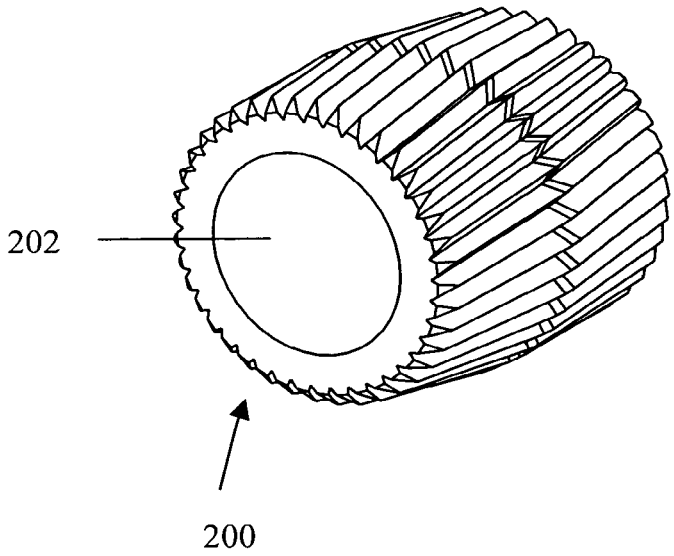
FIG. 6 is a perspective view of a tool according to an embodiment of the invention.

Certain embodiments of the invention also include methods and tools for making boiling surfaces on a tube. A grooving tool 200, such as that shown in FIG. 6, is particularly useful in forming primary grooves 108. Grooving tool 200 has an outer diameter greater than inner diameter of tube 100, so that when pulled or pushed through tube 100, primary grooves 108 are formed. Grooving tool 200 also includes aperture 202 for attaching to a shaft 130 (shown in FIG. 10).

Cutting/lifting tool 300, shown in FIGS. 7A-D and FIGS. 8A-D, may be used to form protrusions 110 and secondary grooves 112. Cutting/lifting tool 300 can be made from any material having the structural integrity to withstand metal cutting (e.g., steel, carbide, ceramic, etc.), but is preferably made of carbide. The embodiments of cutting/lifting tool 300 shown in FIGS. 7A-D and 8A-D generally have a tool axis q, two base walls 312 and one or more side walls 314. Aperture 308 is located through cutting/lifting tool 300. Tips 302 are formed on side walls 314 of cutting/lifting tool 300. Note, however, that the tips 302 can be mounted or formed on any structure than can support the tips 302 in the desired orientation relative to the tube 100 and such structure is not limited to that disclosed in FIGS. 7A-D and 8A-D. Moreover, the tips 302 may be retractable within their supporting structure so that the number of tips 302 used in the cutting process can be easily varied.

FIGS. 7A-D illustrate one embodiment of cutting/lifting tool 300 having a single tip 302. FIGS. 8A-D illustrate an alternative embodiment of cutting/lifting tool 300 having four tips 302. One skilled in the art will understand that cutting/lifting tool 300 may be equipped with any number of tips 302 depending on the desired pitch $P_{a,p}$ of protrusions 110. Moreover, the geometry of each tip 302 need not be the same for tips 302 on a single cutting/lifting tool 300. Rather, tips 302 having different geometries to form protrusions 110 having different shapes, orientations, and other geometries may be provided on cutting/lifting tool 300.

Each tip 302 is formed by the intersection of planes A, B, and C. The intersection of planes A and B form cutting edge 304 that cuts through inner surface 104 to form layers as a first step to forming protrusions 110. Plane B is oriented at an angle $\phi$ relative to a plane perpendicular to the tool axis q (see FIG. 7B). Angle $\phi$ is defined as 90°−θ. Thus, angle $\phi$ is preferably between approximately 40°-70° to allow cutting edge 304 to slice through inner surface 104 at the desirable angle θ between approximately 20°-50°.

Figure 14:
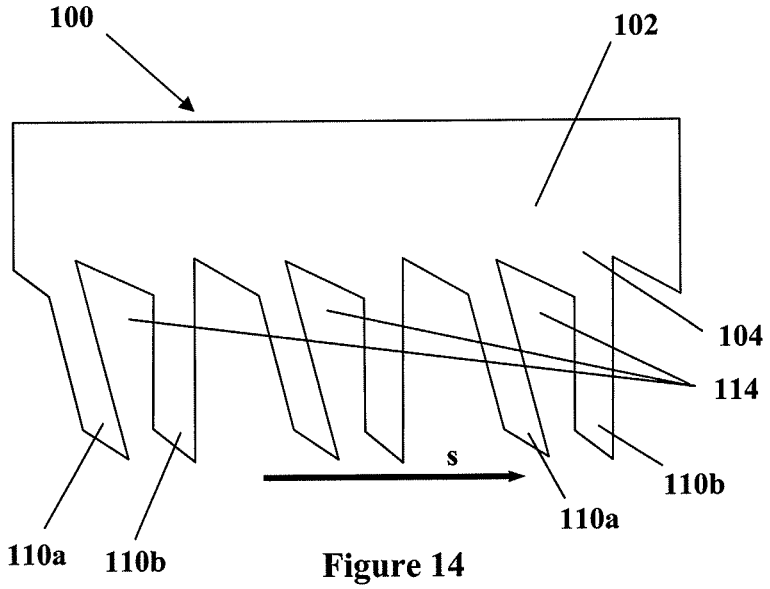
FIG. 14 is a cross-sectional view of a boiling surface on the inner surface of a heat transfer tube according to yet another embodiment of the invention.

The intersection of planes A and C form lifting edge 306 that lifts inner surface 104 upwardly to form protrusions 110. Angle $\phi_1$ is defined by plane C and a plane perpendicular to tool axis q. Angle $\phi_1$ determines the angle of inclination ω (the angle between a plane perpendicular to the longitudinal axis s of tube and the plane of the longitudinal axis of protrusions 110) at which protrusions 110 are lifted by lifting edge 306. Angle $\phi_1$=angle ω, and thus angle $\phi_1$ on cutting/lifting tool 300 can be adjusted to directly impact the angle of inclination ω of protrusions 110. The angle of inclination ω (and angle $\phi_1$) is preferably the absolute value of any angle between approximately −45° to 45° relative to the plane perpendicular to the longitudinal axis s of tube. In this way, protrusions 110 can be aligned with the plane perpendicular to the longitudinal axis s of tube or incline to the left and right relative to the plane perpendicular to the longitudinal axis s of tube 100. Moreover, the tips 302 can be formed to have different geometries (i.e., angle $\phi_1$ may be different on different tips 302), and thus the protrusions 110 within tube 100 may incline at different angles (or not at all) and in different directions relative to the plane perpendicular to the longitudinal axis s of tube 100. FIG. 14 illustrates an example of a tube 100 having protrusions 110, some of which protrusions 110*a* extend from the inner surface 104 of the tube 100 in a direction that is not substantially perpendicular to the longitudinal axis s and some of which protrusions 110*b* project from the inner surface 104 in a direction substantially perpendicular to the longitudinal axis s. Positioning such substantially perpendicularly and substantially non-perpendicularly extending protrusions adjacent each other helps to create boiling cavities 114 between each such protrusions.

Figure 5C:
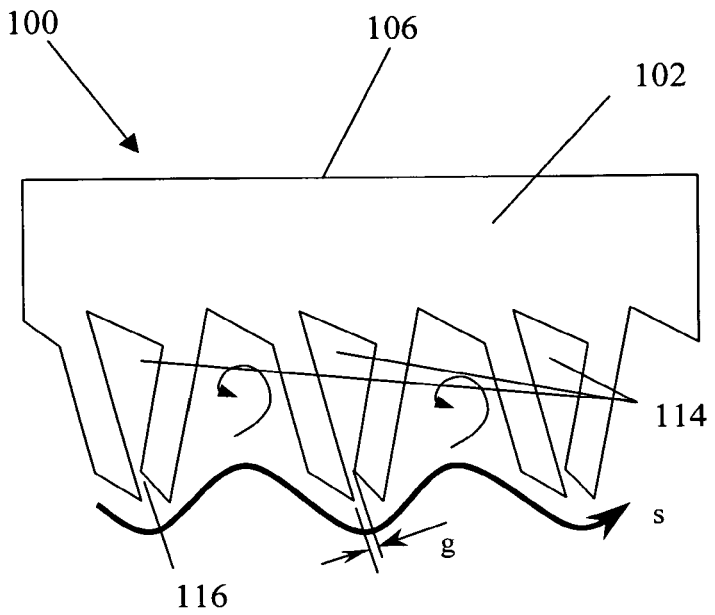
FIG. 5C is a cross-sectional view of the boiling surface of FIG. 5A.

As shown in FIG. 13, a cutting/lifting tool 300 may incorporate cutting tips at two different angles. On a cutting/lifting tool 300 with four cutting tips, two pairs of cutting tips 318, 320 may be used to create a boiling surface with inclined protrusions 110, such as is shown in FIGS. 5A-C. To create such a surface, the neighboring tips 318, 320 must have different angles $\phi_1$. Changing the inclination angle of the protrusions 120 is possible to obtain a particular gap g between protrusions 120 at the opening 116 of the boiling cavity 114, which affects the curved fluid flow s along the surface 104.

Thus, the gap g obtained may be calculated as follows:

$$g = p\cdot(1-\sin(\varphi)) - tg(90-\varphi_1)\cdot\left[\frac{2t\cdot\sin(\varphi_1)}{\sin\varphi} - p\cdot\sin(\varphi)\cdot(1-\sin(\varphi))\right]$$

Where:

p is the axial pitch of the protrusions 110;

$\phi$ is the angle between plane B and a plane perpendicular to tool axis q;

$\phi_1$ is the angle of the tool 300 between plane C and a plane perpendicular to tool axis q; and t is the depth of cutting.

While preferred ranges of values for the physical dimensions of protrusions 110 have been identified, one skilled in the art will recognize that the physical dimensions of cutting/lifting tool 300 may be modified to impact the physical dimensions of resulting protrusions 110. For example, the depth t that cutting edge 304 cuts into inner surface 104 and angle $\phi$ affect the height $e_p$ of protrusions 110. Therefore, the height $e_p$ of protrusions 110 may be adjusted using the expression:

$$e_p = t/\sin(90-\phi)$$

or, given that $\phi=90-\theta$, $$e_p = t/\sin(\theta)$$

Where:

t is the cutting depth;

$\phi$ is the angle between plane B and a plane perpendicular to tool axis q; and $\theta$ is the angle at which the layers are cut relative to the longitudinal axis s of the tube 100.

Thickness $S_p$ of protrusions 110 depends on pitch $P_{a,p}$ of protrusions 110 and angle $\phi$. Therefore, thickness $S_p$ can be adjusted using the expression:

$$S_p = P_{a,p} \cdot \sin(90-\phi)$$

or, given that $\phi=90-\theta$, $$S_p = P_{a,p} \cdot \sin(\theta)$$

Where:

$P_{a,p}$ is the axial pitch of protrusions 110;

$\phi$ is the angle between plane B and a plane perpendicular to tool axis q; and $\theta$ is the angle at which inner surface 104 is cut relative to the longitudinal axis s of the tube 100.

Figure 10:
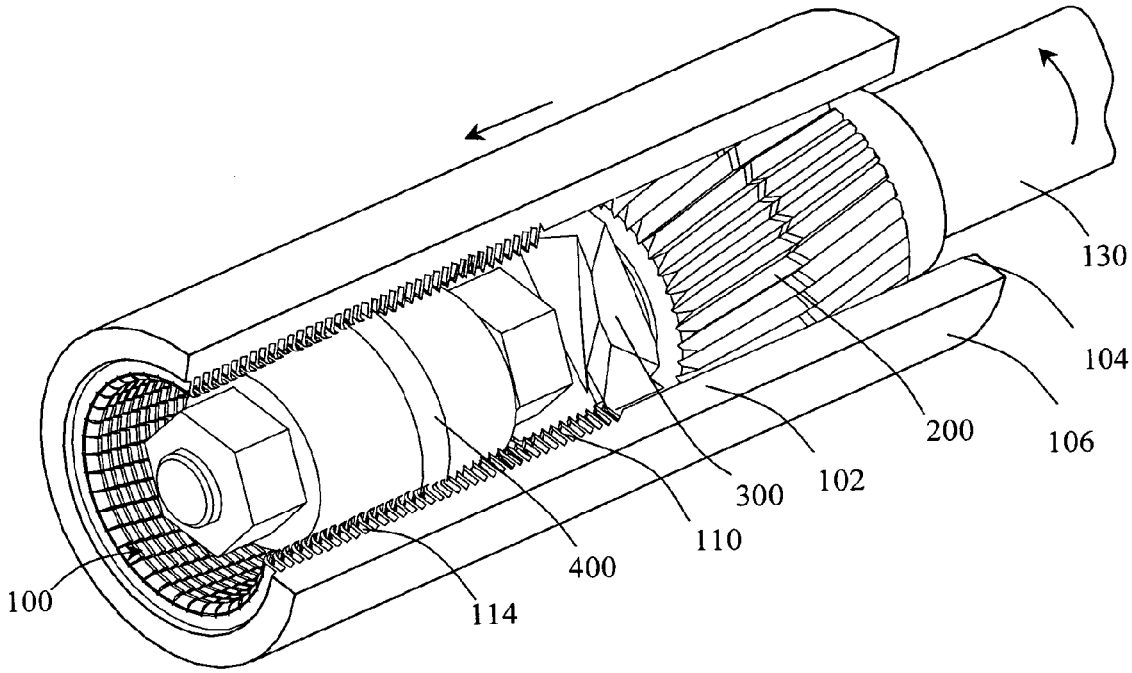
FIG. 10 is a perspective view of an embodiment of the manufacturing equipment than can be used to produce heat transfer tubes in accordance with this invention.
Figure 11:
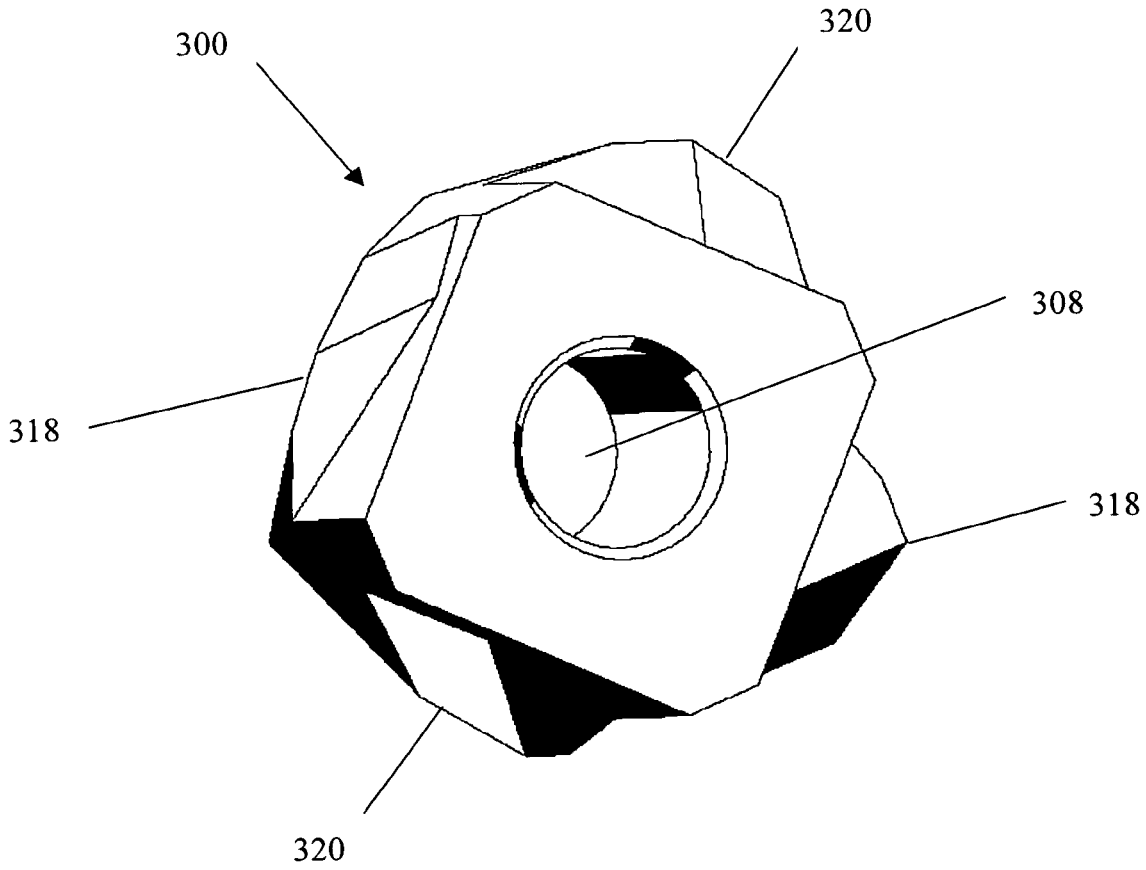
FIG. 11 is perspective view of a tool according to another embodiment of the invention.

In certain embodiments of the invention, the tips 124 of protrusions 110 may be flattened or bent using flattening tool 400, shown in FIG. 10. The flattening tool 400 preferably has a diameter greater than the diameter of protrusions 110 on inner surface 104. Thus, when flattening tool 400 is pushed or pulled through tube 100, the tips 124 of protrusions 110 are bent or flattened. Flattening tool 400 includes an aperture 402 for attaching to shaft 130.

Figure 3A:
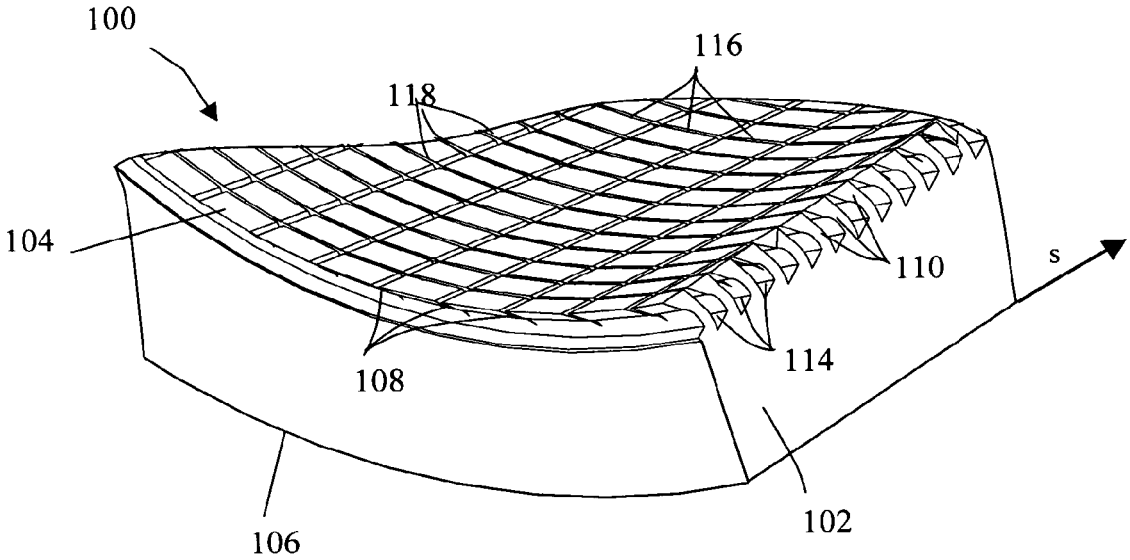
FIG. 3A is a perspective view of a boiling surface on the inner diameter of a heat transfer tube according to an alternative embodiment of the invention.
Figure 3B:
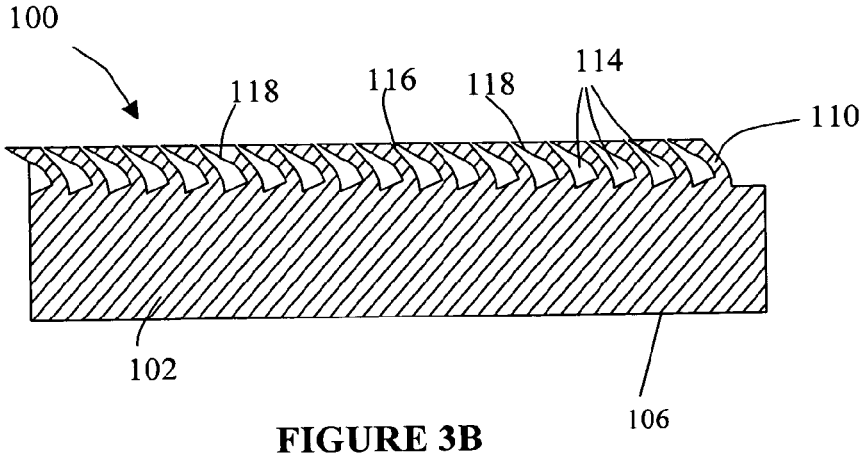
FIG. 3B is a sectional view of the tube shown in FIG. 3A.
Figure 3C:
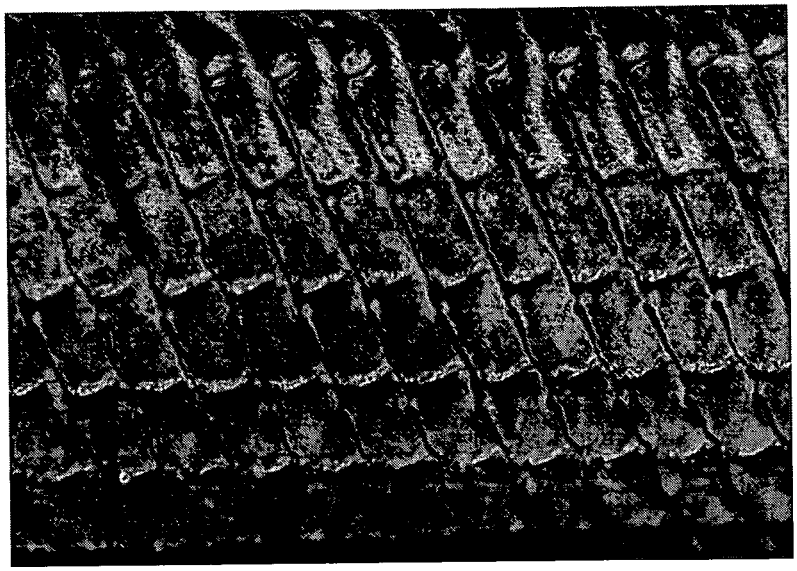
FIG. 3C is a photomicrograph of a top plan view the boiling surface of FIG. 3A.
Figure 3D:
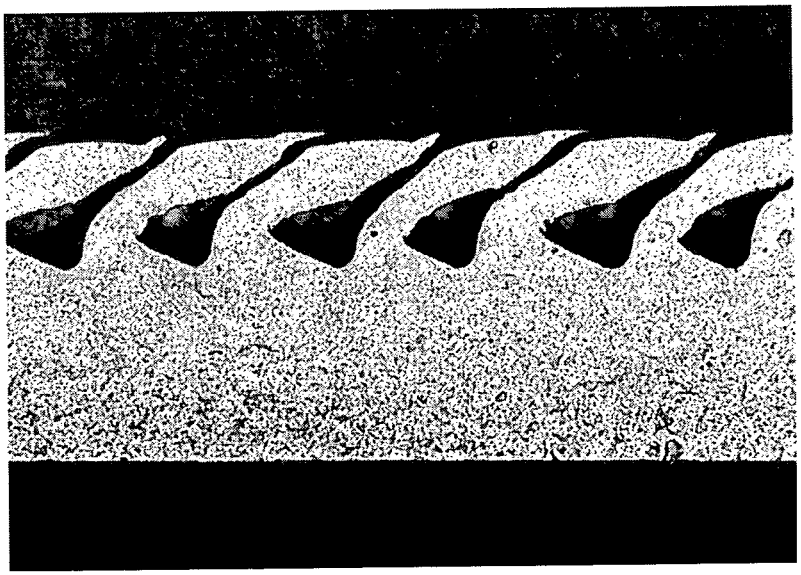
FIG. 3D is a photomicrograph of a cross-section of the boiling surface of FIG. 3A.
Figure 9A:
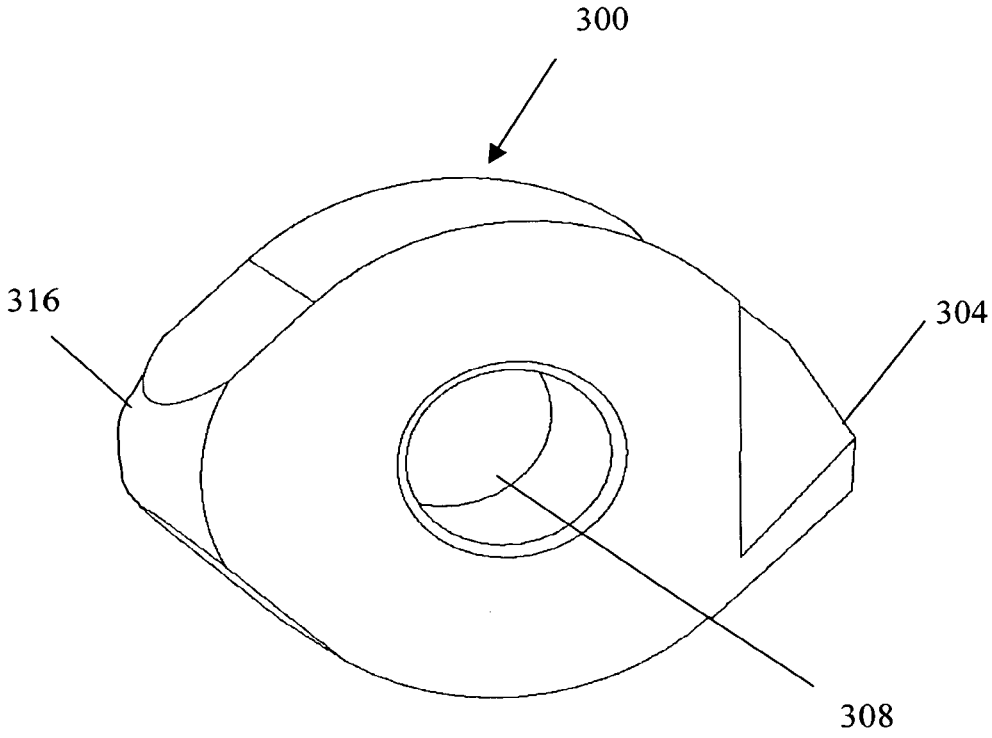
FIG. 9A is perspective view of a tool according to another embodiment of the invention.
Figure 9B:
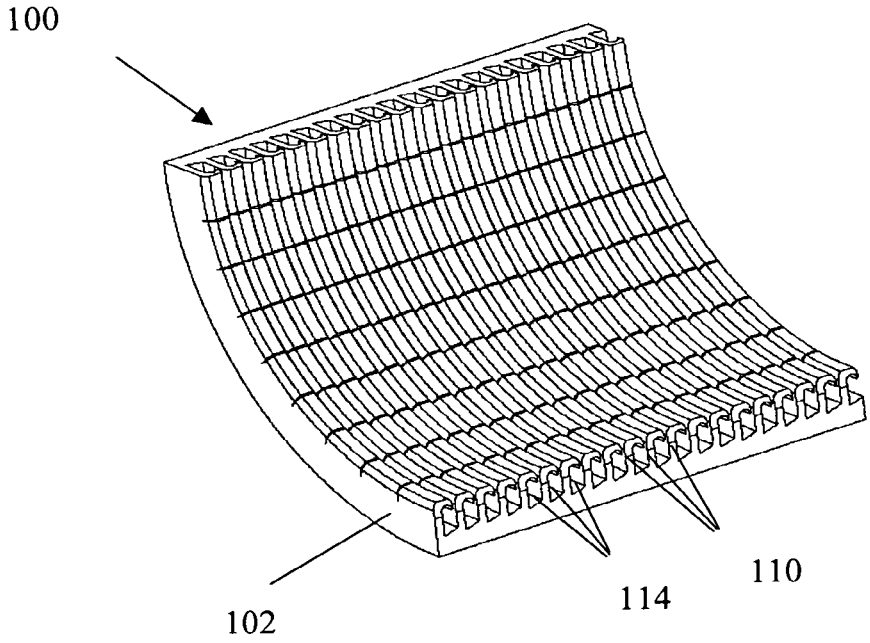
FIG. 9B is a perspective view of a boiling surface formed by the tool of FIG. 9.
Figure 9C:
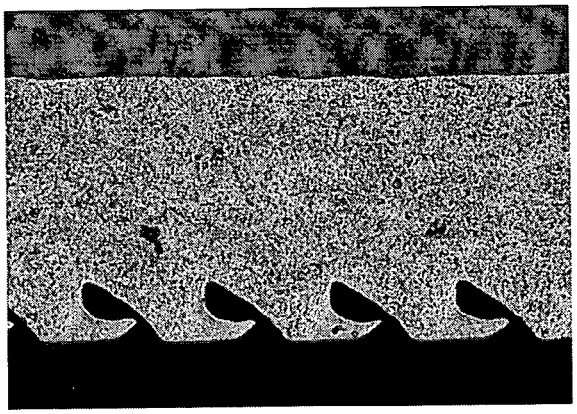
FIG. 9C is a photomicrograph of the boiling surface of FIG. 9.

In other embodiments, the tips 124 of protrusions 110 may achieve a shape similar to the flattened or bent tips 124 shown in FIGS. 3A-B without the use of a flattening tool 400. For example, the cutting/lifting tool 300 may incorporate tips 302 capable of creating protrusions 110 with a shape similar to protrusion tips 124 that have been flattened, such as shown in FIGS. 4A-B. In other embodiments, the cutting/lifting tool 300 may incorporate a tip 316 for flattening the tips 124 of protrusions 110, as shown in FIG. 9B. A cutting/lifting tool 300 as shown in FIG. 9A may be used to create a boiling surface such as that shown in FIG. 9B-C.

Figure 12A:
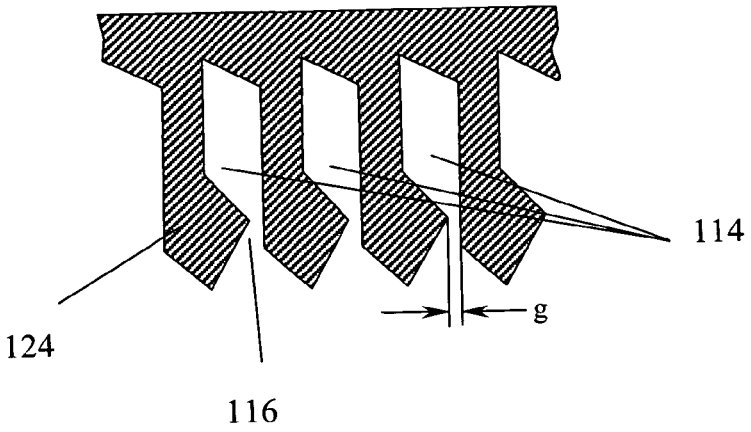
FIG. 12A is a perspective view of a boiling surface on the inner diameter of a heat transfer tube in accordance with alternative embodiment of the invention.
Figure 12B:
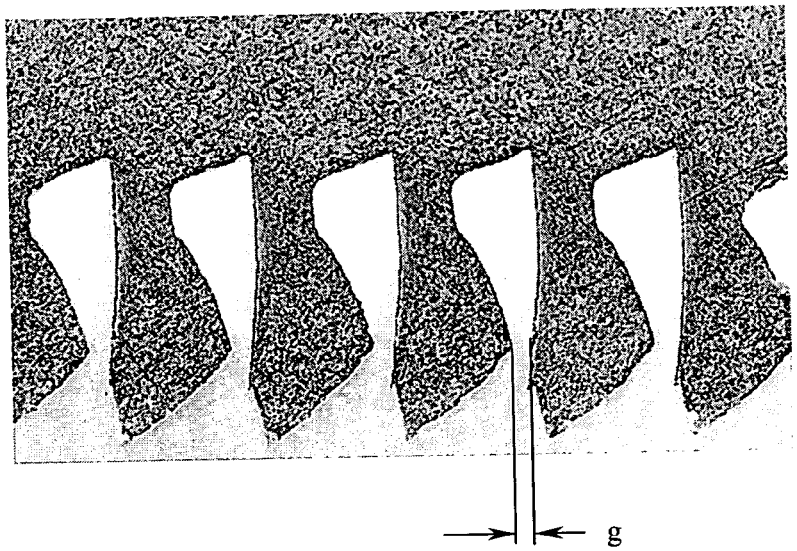
FIG. 12B is a photomicrograph of cross-section of the boiling surface of FIG. 12B.

Boiling surfaces for use on heat transfer surfaces may also be achieved by creating protrusions 110 with thickened tips 124. As shown in FIGS. 12A-B, heat transfer surfaces with thickened tips 124 can be used to create boiling cavities 114. Protrusions 110 with thickened tips 124 can be obtained using the following formulas, with reference to FIGS. 13A-B:

$$\frac{p}{t-t_1} \geq \frac{\sin(\varphi_3-\varphi_2)\cdot\sin\varphi_3}{\cos\varphi_2}$$

Figure 13A:
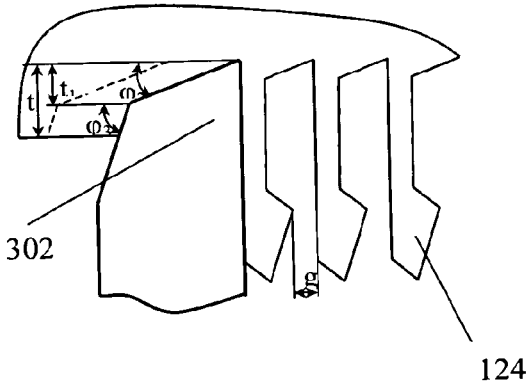
FIG. 13A is a sectional view of a boiling surface as it is formed with a cutting tip in accordance with an embodiment of the invention.
Figure 13B:
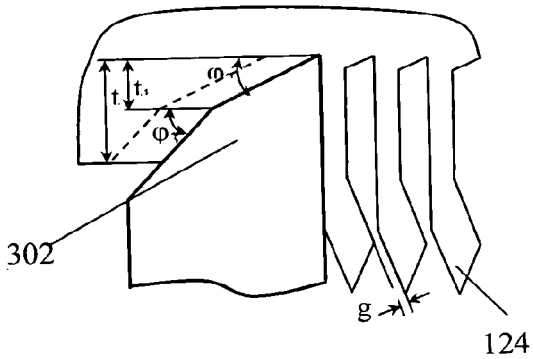
FIG. 13B is a sectional view of a boiling surface as it is formed with a cutting/lifting tip in accordance with an alternative embodiment of the invention.

Where:

$\phi_2$ is the angle between projection of the first site of a cutting edge and direction of tool feed;

$\phi_3$ is the angle between projection of the second site of a cutting edge and direction of tool feed;

t is the full depth of cutting; and $t_1$ is the depth of cutting for the first site of cutting edge, then the protrusion tips 124 will be as shown in FIG. 13B and, the gap g may be calculated as follows:

$$g = p\cdot(1-\sin(\varphi_2)) - \frac{(t-t_1)\cdot\sin(\varphi_3-\varphi_2)}{\sin(\varphi_3)}$$

If the following is true:

$$\frac{p}{t-t_1} \leq \frac{\sin(\varphi_3-\varphi_2)\cdot\sin\varphi_3}{\cos\varphi_2}$$

then the protrusion tips 124 will be as shown in FIG. 13B and the gap g may be calculated as follows:

$$g = p\cdot\cos(\phi_3-\phi_2)\cdot(1\cdot\sin(\phi_2)\cdot\cos(\phi_2)\cdot(tg(\phi_3-\phi_2)).$$

Figure 13C:
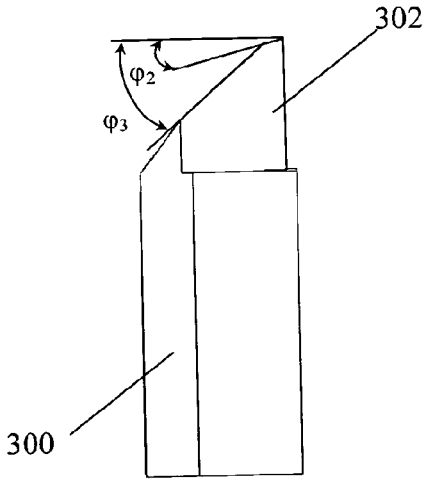
FIG. 13C is a sectional view of a cutting/lifting tip according to an embodiment of the invention that may be used to form the boiling surfaces of FIGS. 13A and 13B.
Figure 13D:
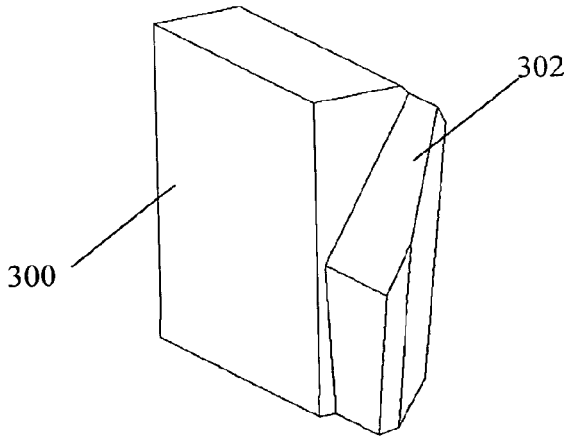
FIG. 13D is a perspective view of a cutting/lifting tip according to an embodiment of the invention that may be used to form the boiling surfaces of FIGS. 13A and 13B.

FIGS. 13C-D illustrate an embodiment of a cutting/lifting tool 300 that may be used to create protrusions 110 with thickened tips 124.

FIG. 10 illustrates one possible manufacturing set-up for enhancing the surfaces of tube 100. These figures are in no way intended to limit the process by which tubes 100 in accordance with this invention are manufactured, but rather any tube manufacturing process using any suitable equipment or configuration of equipment may be used. The tubes 100 of this invention may be made from a variety of materials possessing suitable physical properties including structural integrity, malleability and plasticity, such as, for example, copper and copper alloys, aluminum and aluminum alloys, brass, titanium, steel and stainless steel.

Figure 7A:
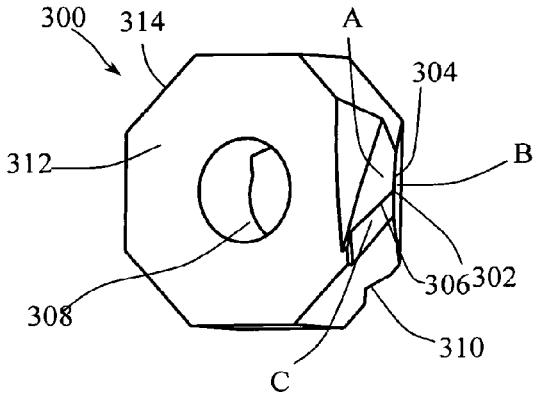
FIG. 7A is a perspective view of a tool according to an alternative embodiment of the invention.
Figure 7B:
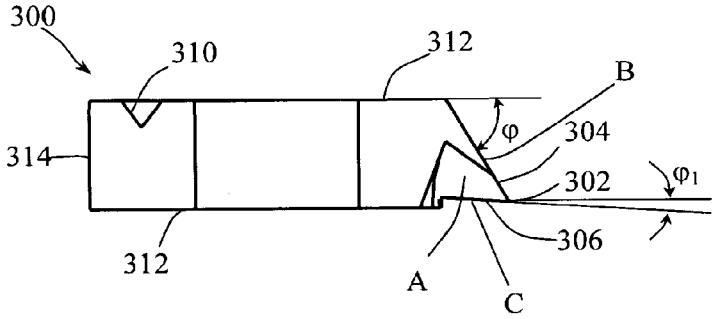
FIG. 7B is a side elevation view of the tool shown in FIG. 7A.
Figure 7C:
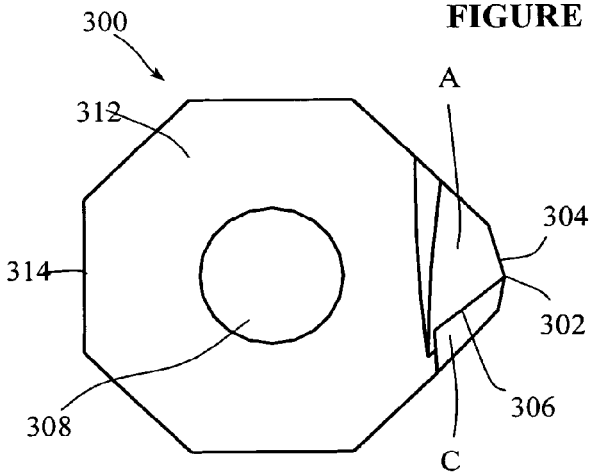
FIG. 7C is a bottom plan view of the tool of FIG. 7A.
Figure 7D:
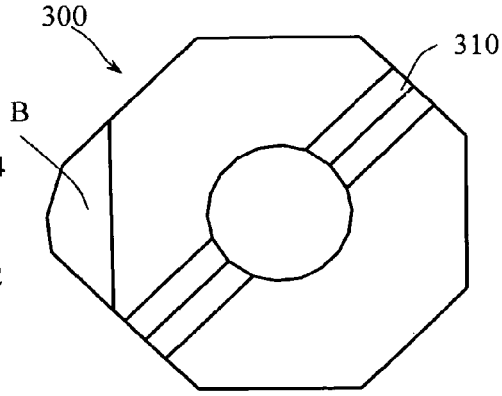
FIG. 7D is a top plan view of the tool of FIG. 7A.
Figure 8A:
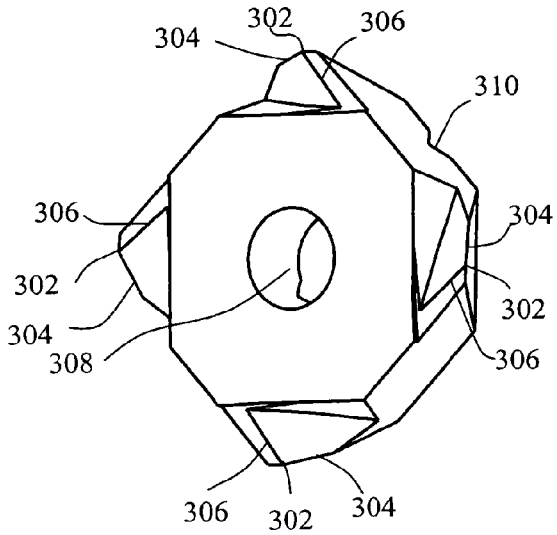
FIG. 8A is a perspective view of a tool according to another embodiment of the invention.
Figure 8B:
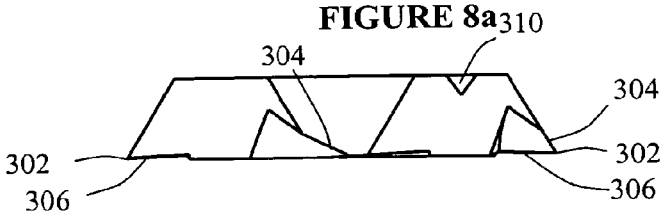
FIG. 8B is a side elevation view of the tool shown in FIG. 8A.
Figure 8C:
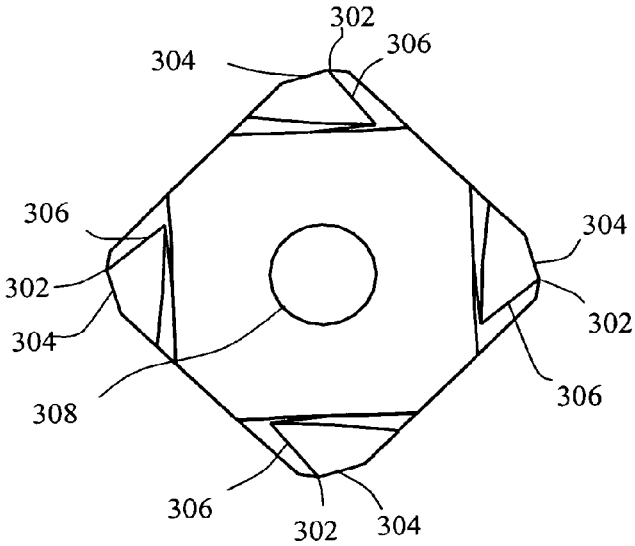
FIG. 8C is a bottom plan view of the tool of FIG. 8A.
Figure 8D:
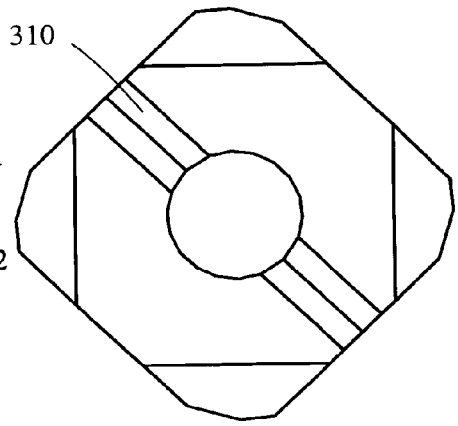
FIG. 8D is a top plan view of the tool of FIG. 8A.

In one example of a way to enhance inner surface 104 of tube 100, a shaft 130, onto which flattening tool 400 is rotatably mounted through aperture 402, extends into tube 100. Cutting/lifting tool 300 is mounted onto shaft 130 through aperture 308. Grooving tool 200 is mounted onto shaft 130 through aperture 202. Bolt 132 secures all three tools 200, 300, 400 in place. The tools 200, 300, 400 are preferably locked in rotation with shaft 130 by any suitable means. FIGS. 7D and 8D illustrate a key groove 310 that may be provided on cutting/lifting tool 300 to interlock with a protrusion on shaft (not shown) to fix cutting/lifting tool 300 into place relative to shaft 130.

Although not shown, when the method and/or tool of the invention is used to create an inner surface of a tube, the manufacturing set-up may include arbors that can be used to enhance the outer surface of tube. Each arbor generally includes a tool set-up having finning disks which radially extrude from one to multiple start outside fins having axial pitch $P_{a,o}$. The tool set-up may include additional disks, such as notching or flattening disks, to further enhance the outer surface of tube. Note, however, that depending on the tube application, enhancements need not be provided on outer surface of tube at all. In operation, tube wall moves between mandrel and the arbors, which exert pressure on tube wall.

The mirror image of a desired inner surface pattern is provided on grooving tool 200 so that grooving tool 200 will form inner surface 104 of tube 100 with the desired pattern as tube 100 engages grooving tool 200. A desirable inner surface 104 includes primary grooves 108, as shown in FIG. 1. After formation of primary grooves 108 on inner surface 104 of tube 100, tube 100 encounters cutting/lifting tool 300, positioned adjacent and downstream grooving tool 200. The cutting edge(s) 304 of cutting/lifting tool 300 cuts through inner surface 104. Lifting edge(s) 306 of cutting/lifting tool 300 then lifts inner surface 104 to form protrusions 110.

When protrusions 110 are formed simultaneously with outside finning and cutting/lifting tool 300 is fixed (i.e., not rotating or moving axially), tube 100 automatically rotates and has an axial movement. In this instance, the axial pitch of protrusions 110 $P_{a,p}$ is governed by the following formula:

$$P_{a,p} = \frac{P_{a,o} \cdot Z_o}{Z_i}$$

Where:

$P_{a,o}$ is the axial pitch of outside fins;

$Z_o$ is the number of fin starts on the outer diameter of tube; and $Z_i$ is the number of tips 302 on cutting/lifting tool 300.

To obtain a specific protrusion axial pitch $P_{a,p}$, cutting/lifting tool 300 can also be rotated. Both tube 100 and cutting/lifting tool 300 can rotate in the same direction or, alternatively, both tube 100 and cutting/lifting tool 300 can rotate, but in opposite directions. To obtain a predetermined axial protrusion pitch $P_{a,p}$, the necessary rotation (in revolutions per minute (RPM)) of the cutting/lifting tool 300 can be calculated using the following formula:

$$RPM_{tool} = \frac{RPM_{tube}(P_{a,o} \cdot Z_o - P_{a,p} \cdot Z_i)}{Z_i \cdot P_{a,p}}$$

Where:

$RPM_{tube}$ is the frequency of rotation of tube 100;

$P_{a,o}$ is the axial pitch of outer fins;

$Z_o$ is the number of fin starts on the outer diameter of tube;

$P_{a,p}$ is the desirable axial pitch of protrusions 110; and $Z_i$ is the number of tips 302 on cutting/lifting tool 300.

If the result of this calculation is negative, then cutting/lifting tool 300 should rotate in the same direction of tube 100 to obtain the desired pitch $P_{a,p}$. Alternatively, if the result of this calculation is positive, then cutting/lifting tool 300 should rotate in the opposite direction of tube 100 to obtain the desired pitch $P_{a,p}$.

Note that while formation of protrusions 110 is shown in the same operation as formation of primary grooves 108, protrusions 110 may be produced in a separate operation from primary grooves 108 by using a tube 100 with pre-formed primary grooves 108. This would generally require an assembly to rotate cutting/lifting tool 300 or tube 100 and to move cutting/lifting tool 300 or tube 100 along the tube axis. Moreover, a support (not shown) is preferably provided to center cutting/lifting tool 300 relative to the inner tube surface 14.

In this case, the axial pitch $P_{a,p}$ of protrusions 110 is governed by the following formula:

$$P_{a,p} = X_a/(RPM \cdot Z_i)$$

Where:

$X_a$ is the relative axial speed between tube 100 and cutting/lifting tool 300 (distance/time);

RMP is the relative frequency of rotation between cutting/lifting tool 300 and tube 100;

$P_{a,p}$ is the desirable axial pitch of protrusions 110; and $Z_i$ is the number of tips 302 on cutting/lifting tool 300.

This formula is suitable when (1) the tube 100 moves only axially (i.e., does not rotate) and the cutting/lifting tool 300 only rotates (i.e., does not move axially); (2) the tube 100 only rotates and the cutting/lifting tool 300 moves only axially; (3) the cutting/lifting tool 300 rotates and moves axially but the tube 100 is both rotationally and axially fixed; (4) the tube 100 rotates and moves axially but the tool 10 is both rotationally and axially fixed; and (5) any combination of the above.

With the inner tube surface 104 of this invention, additional paths for fluid flow are created (between protrusions 110 through secondary grooves 112) to optimize heat transfer and pressure drop. FIG. 5C illustrates these additional paths for fluid travel through tube 100. These paths are in addition to the fluid flow paths created between primary grooves 108. These additional paths have a helix angle $\alpha_1$ relative to the tube axis s. Angle $\alpha_1$ is the angle between protrusions 110 formed from adjacent primary grooves 108. Helix angle $\alpha_1$, and thus orientation of paths 128 through tube 100, can be adjusted by adjusting pitch $P_{a,p}$ of protrusions 110 using the following expression $$P_{a,p} = \frac{P_{a,r} \cdot \tan(\alpha) \cdot \pi D_i}{\pi D_i \cdot (\tan(\alpha) + \tan(\alpha_1)) \pm P_{a,r} \cdot \tan(\alpha) \cdot \tan(\alpha_1) \cdot Z_i}$$

Where:

$P_{a,r}$ is the axial pitch of primary grooves 108;

$\alpha$ is the angle of primary grooves 108 to tube axis s;

$\alpha_1$ is the desirable helix angle between protrusions 110;

$Z_i$ is the number of tips 302 on cutting/lifting tool 300; and $D_i$ is the inside diameter of tube 100 measured from inner surface 104 of tube 100.

The foregoing description is provided for describing various embodiments and structures relating to the invention. Various modifications, additions and deletions may be made to these embodiments and/or structures without departing from the scope and spirit of the invention.

What is claimed is:

1. A method of manufacturing a tube having a surface, at least two primary grooves located along the surface, and a longitudinal axis, the method comprising:

a. using a tool having a tool tip (i) to cut with the tool tip through the surface of the tube located between the at least two primary grooves to a cutting depth, and at an angle relative to the longitudinal axis, to form layers, wherein at least one layer is formed by cutting with the tool tip through the surface of the tube at two different angles relative to the longitudinal axis; and (ii) to lift the layers relative to the surface with the tool tip to form a plurality of protrusions, wherein at least some of the protrusions are adjacent each other, wherein at least one of the plurality of protrusions comprises a protrusion base and a protrusion tip and wherein the protrusion tip is more distal the surface than the protrusion base and thicker than the protrusion base.

2. The method of claim 1, wherein the surface is an inner surface of the tube.

3. The method of claim 2, wherein the tube has an inside diameter and each of the plurality of protrusions has a height, wherein the ratio of each protrusion height to tube inside diameter is between approximately 0.002 and 0.5.

4. The method of claim 1, wherein the at least two primary grooves are located along the surface at an angle not more than 70° relative to the longitudinal axis of the tube.

5. The method of claim 1, wherein the at least two primary grooves have a depth of at least 0.001 inches.

6. The method of claim 1, wherein the at least two grooves have an axial pitch of approximately 0.5 to 5.0 mm.

7. The method of claim 1, wherein at least some of the plurality of protrusions have a height that is a value of no more than three times the cutting depth.

8. The method of claim 1, wherein at least some of the plurality of protrusions project from the surface in a direction substantially perpendicular to the longitudinal axis.

9. The method of claim 1, wherein at least some of the plurality of protrusions project from the surface in a direction that is not substantially perpendicular to the longitudinal axis.

10. The method of claim 1, wherein a boiling cavity is formed between the at least one of the plurality of protrusions having a protrusion base and a protrusion tip, the protrusion tip being more distal the surface than the protrusion base and thicker than the protrusion base, and an adjacent protrusion.

11. The method of claim 1, wherein at least some of the plurality of protrusions are adjacent and wherein at least some of the adjacent protrusions are angled relative to each other.

12. The method of claim 1, wherein the plurality of protrusions comprise protrusion tips and wherein the protrusion tips of at least some of the plurality of protrusions are bent.

13. The method of claim 1, wherein the plurality of protrusions comprise protrusion tips and wherein the protrusion tips of at least some of the plurality of protrusions are flattened.

14. The method of claim 1, wherein at least one of the plurality of protrusions projects from the surface in a direction substantially perpendicular to the longitudinal axis and at least one of the plurality of protrusions projects from the surface in a direction that is not substantially perpendicular to the longitudinal axis.

15. The method of claim 1, wherein the at least two primary grooves each comprises a groove axis and wherein cutting through the surface of the tube located between the at least two primary grooves comprises cutting through the surface of the tube at an angle to the groove axis of at least one of the at least two primary grooves.

16. The method of claim 1, wherein lifting the layers forms a plurality of secondary grooves extending between the at least two primary grooves.

17. The method of claim 16, wherein the secondary grooves are located along the surface at an angle between approximately 80° and 100° relative to the longitudinal axis of the tube.

18. A method of manufacturing a tube having at least two primary grooves, and a surface located between the at least two primary grooves and having a width, the method comprising:

a. cutting through, and across the width of, the surface to a cutting depth and at an angle relative to the longitudinal axis to form layers, wherein at least one layer is formed by cutting through the surface at two different angles relative to the longitudinal axis; and b. upwardly lifting the layers relative to the surface to form a plurality of protrusions and a plurality of secondary grooves extending between the at least two primary grooves, wherein at least one of the plurality of protrusions comprises a base and a protrusion tip and wherein the protrusion tip is more distal the surface than the base and thicker than the base.

19. The method of claim 18, further comprising providing a tool with a tool tip, wherein cutting and upwardly lifting the layers is performed by the tool tip.

* * * * *